United States Patent [19]

Goldstein et al.

[11] Patent Number: 4,734,076

[45] Date of Patent: Mar. 29, 1988

[54] TOY VEHICLE PLAY SETTING

[75] Inventors: Samuel M. Goldstein, Los Angeles; Timothy S. Engle, Manhattan Beach; Walter A. Kristkeitz, Los Angeles; Eric C. Ostendorff, Torrance, all of Calif.

[73] Assignee: Mattel, Inc., Hawthorne, Calif.

[21] Appl. No.: 802,130

[22] Filed: Nov. 26, 1985

[51] Int. Cl.[4] ..... A63H 17/44

[52] U.S. Cl. ..... 446/423; 446/4; 446/476

[58] Field of Search ..... 446/423, 424, 431, 4, 446/476

[56] References Cited

U.S. PATENT DOCUMENTS

| | | | |
|---|---|---|---|
| 2,036,802 | 4/1936 | Fleishman et al. | 446/423 |
| 2,050,892 | 4/1936 | Marx | 446/216 |
| 2,135,584 | 11/1938 | Lohr | 446/409 |
| 2,522,160 | 9/1950 | Borchers | 446/423 |
| 2,590,508 | 3/1952 | Carver et al. | 446/423 |
| 2,776,522 | 1/1957 | Schramm et al. | 446/423 |
| 3,451,261 | 6/1969 | Olsen . | |
| 3,757,562 | 9/1973 | Goldberg et al. | 73/12 |
| 4,261,133 | 4/1981 | Hanson et al. | 446/424 X |
| 4,356,657 | 11/1982 | Goldfarb et al. | 446/423 X |

*Primary Examiner*—Mickey Yu

*Attorney, Agent, or Firm*—Ronald M. Goldman; Melvin A. Klein; Daniel F. Sullivan

[57] ABSTRACT

A toy vehicle play setting simulating a crash test and repair station for use with toy vehicles having body components rotatable on impact to simulate damage from a collision, the setting having a supporting surface member with at least one garage like structure thereon with at least one body repair mechanism therein, with other impact mechanisms for actuating the body component of the vehicle, and for simulating damage to the structure from impact therewith.

6 Claims, 9 Drawing Figures

TOY VEHICLE PLAY SETTING

CROSS-REFERENCE TO RELATED PATENT APPLICATION

The subject matter of this patent application is related to the subject matter of co-pending U.S. Patent Application Ser. No. 566,591, filed Dec. 29, 1983, entitled "Toy Vehicle Game with Launcher and Return Means", by Wayne R. Halford and Walter S. Nakano, and assigned to Mattel, Inc., the assignee herein, the play setting of the instant application being adapted for use with the toy vehicles depicted in such co-pending application.

BACKGROUND OF THE INVENTION

The background of the invention will be discussed in two parts:

1. Field of the Invention

This invention relates to play settings for toy vehicles, and more particularly to a play setting which has action simulating assemblies thereon.

2. Description of the Prior Art

Toy vehicles, along with tracks, structures, play settings and accessory items therefor, have been a source of amusement for decades, particularly the types of toy vehicles and accessory items which provide some form of action, or flexibility in play situations. Numerous structures for use with toy vehicles have been developed, with such structures simulating garages, firehouses, and the like, and have usually been provided with some action device for enhancing the amusement when playing therewith.

One such early structure is shown and described in U.S. Pat. No. 2,036,802, issued April 7, 1936 to Fleishman et al, for a "Toy Garage", in which a garage type structure is provided with a spring operated door actuable upon a toy vehicle depressing a ramp at the front thereof.

Another such structure is shown and described in U.S. Pat. No. 2,050,892, entitled "Toy Fire House", issued to Marx on Aug. 11, 1936, the structure being provided with a propulsion means for propelling unpowered vehicles therefrom in response to depression of an actuator in the form of a chimney, depression of which also actuates a siren.

U.S. Pat. No. 2,135,584, is directed to another such structure, and is entitled "Toy Fire House", such patent being issued to Lohr on Nov. 8, 1938, the structure including pusher devices in two bays, for propelling two unpowered toy vehicles in sequence, with an alarm in the form of a bell being actuated for a time period after ejection of the vehicles.

U.S. Pat. No. 2,522,160, entitled "Spring Ejected Toy Vehicle", issued to Borchers, on September 12, 1950, such patent disclosing a garage like structure having spring operated propulsion devices actuated by the opening of the door thereof.

Another vehicle structure is shown and described in U.S. Pat. No. 2,590,508, issued to Carver et al, on March 25, 1952, such patent being entitled "Toy With Automatic Door", the toy being in the form of a garage with a spring operated folding door actuated upon impact by a vehicle.

Another such structure is shown in U.S. Pat. No. 2,776,522, issued Jan. 8, 1957, to Schramm et al, for a "Toy Garage", the patent disclosing a toy vehicle parking structure with a turntable having parking stalls and a manually operated conveyor belt coacting with entrance ramps for enabling positioning of a toy vehicle at a predetermined location for parking of the vehicle on the turntable.

U.S. Pat. No. 3,451,261, was issued to Olsen, on June 24, 1969, and is entitled "Automobile Diagnostic Center", the patent disclosing a structure for motor vehicle testing and diagnosis, with a curved roadway with a plurality of stalls extending therefrom, and a central structure windowed for customer observation as the vehicle passes through successive diagnostic stations.

U.S. Pat. No. 3,757,562, entitled "Method of Impact Testing a Metallic Structure", issued to Goldberg et al, on Sept. 11, 1973, and discloses a method in which scale models of the metallic structures are made of plastic material having the same stress-strain characteristics as the metal structure.

It is an object of the present invention to provide a new and improved toy vehicle play setting.

It is another object of the present invention to provide a new and improved play setting simulating a crash test and repair station, and having action accessories thereon for use with toy vehicles.

It is a further object of the present invention to provide a new and improved toy vehicle play setting having a surface with a garage like structure thereon with toy vehicle repair mechanisms therein.

It is a still further object of the present invention to provide a new and improved play setting simulating a crash test and repair facility with action devices for use with unpowered toy vehicles with pivotable body components which simulate collision damage.

SUMMARY OF THE INVENTION

The foregoing and other objects are accomplished by providing a toy vehicle play setting simulating a crash test and repair station for use with toy vehicles having body components rotatable on impact to simulate damage from a collision, the setting having a supporting surface member with at least one garage like structure thereon with at least one body repair mechanism therein, with other impact mechanisms for actuating the body component of the vehicle, and for simulating damage to the structure from impact therewith.

Other objects, features and advantages of the invention will become apparent from a reading of the specification, when taken in conjunction with the drawings, in which like reference numerals refer to like elements in the several views.

DESCRIPTION OF THE PREFERRED EMBODIMENT

Figure 1:
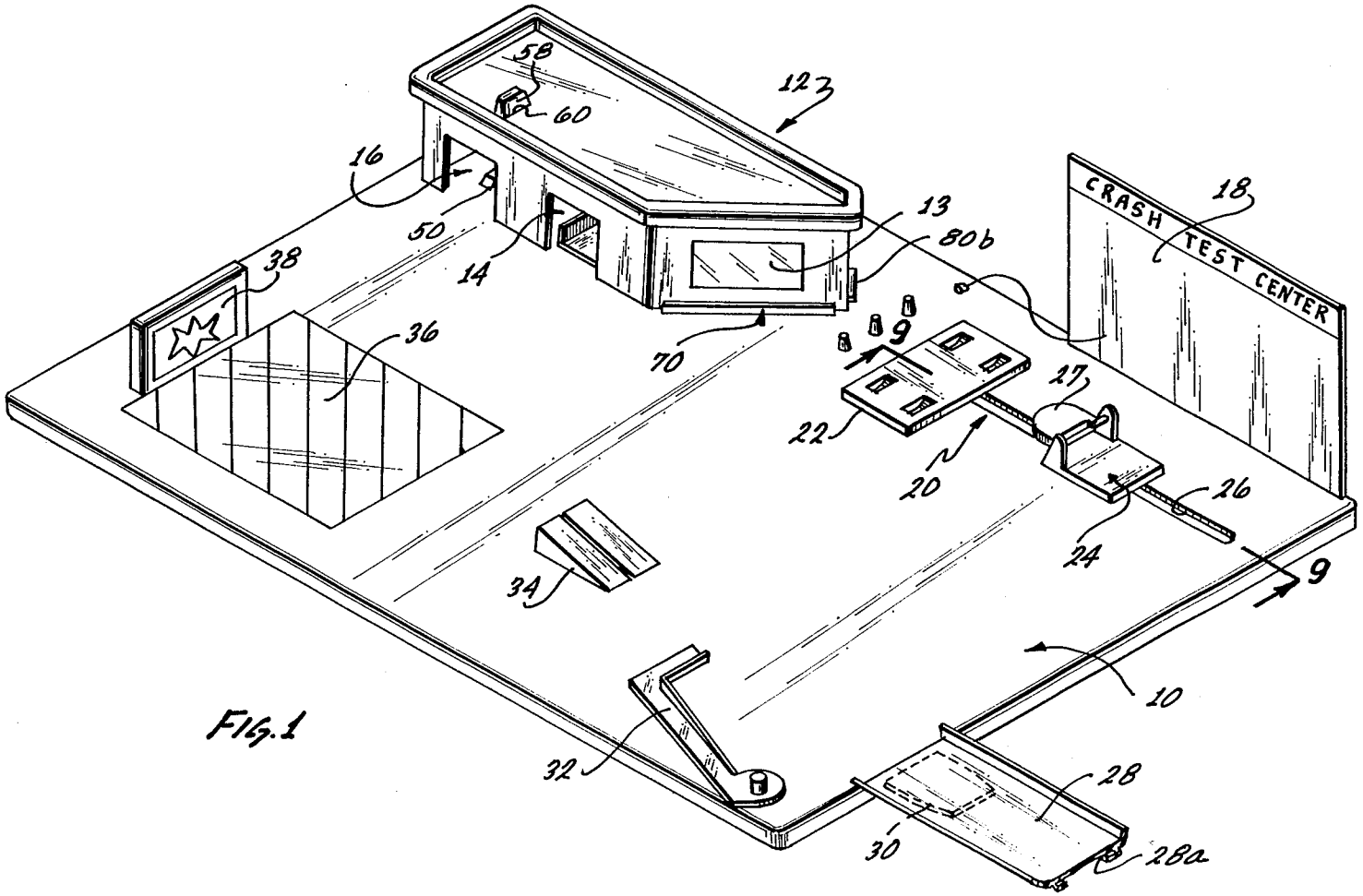
FIG. 1 is a perspective view of the toy vehicle play setting in accordance with the present invention.

Referring now to the drawings, and particularly to FIG. 1, there is shown a toy vehicle play setting, having a supporting surface 10 with a garage like structure 12 at one corner thereof, with first and second openings for providing access for toy vehicles (not shown) to one of two bays 14 and 16. At one edge of the surface 10, there is attached a vertically extending wall member 18, which may be suitably inscribed with appropriate indicia, such as simulated test or diagnostic equipment and the like. Adjacent the wall member 18, there is a first action device, generally designated 20, which includes a toy vehicle reciving rotatable rack member 22, and a collision sled 24, which, as will hereinafter be described, is propelled along slot 26 formed in the surface 10, by means below the surface 10.

Adjacent one corner of the surface 10, a track member 28 is connected to the surface 10 by means of a tongue member 30 which may be inserted partially into slots in the underside of surface 10, and suitably interconnected with the side slots **28*a* formed on the undersurface of track member 28. Adjacent the end of the track member 28, and within the path of a vehicle travelling thereon, there is positioned an action mechanism in the form of a generally L-shaped pivotable barrier 32, which may be pivoted out of the path of an oncoming toy vehicle. In such event the vehicle will contact the ramp 34 in the direct path of travel of a vehicle, and depending on the angle of approach, the vehicle may travel straight ahead onto the "skid" pad 36, and into the wall barrier 38, or alternatively may veer left or right. With a toy vehicle simulating front end damage of the type described in the aforementioned related application, such impact will release the catch mechanism to rotate the component thereof to simulate damage to the vehicle, which damage may then be repaired as will be described. With the barrier 32 positioned to intercept an oncoming vehicle from track 28, the toy vehicle may then be redirected into contact with the window 13** for simulating damage thereto as will be hereafter described.

Figure 2:
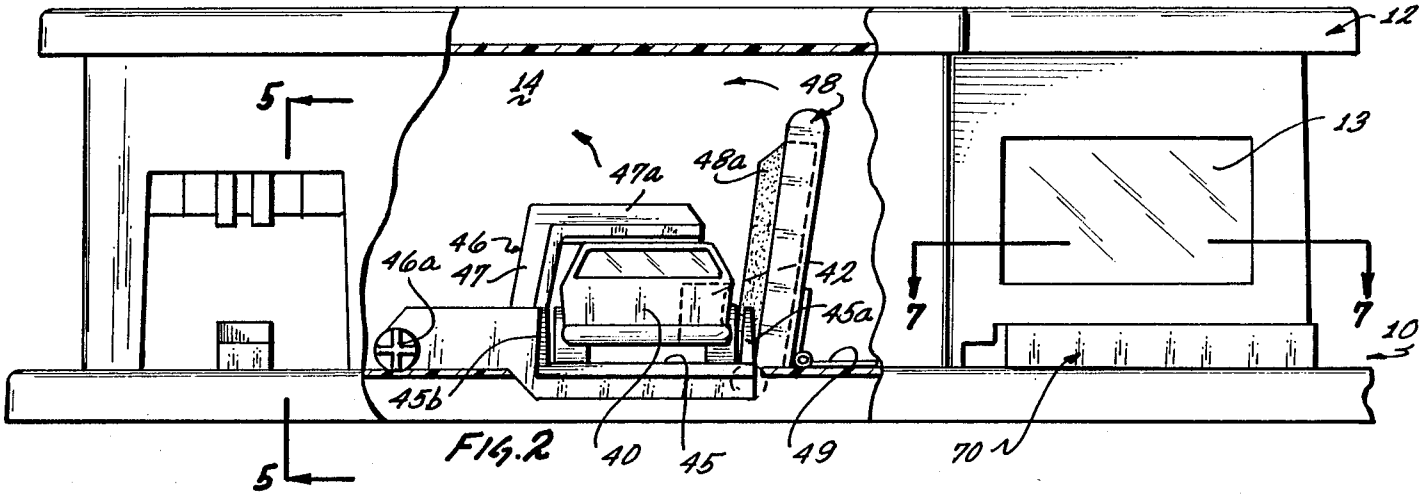
FIG. 2 is a front elevational view of the garage structure of the play setting of FIG. 1, partially broken away, to illustrate the vehicle repair mechanism therein.
Figure 3:
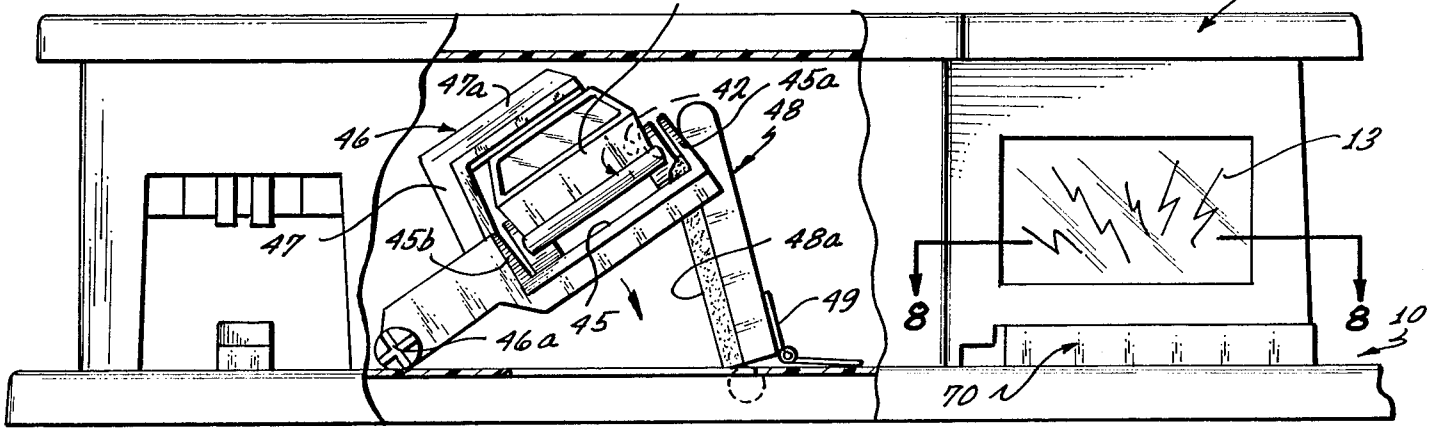
FIG. 3 is a front elevational view similar to FIG. 2 illustrating the mechanism therein in a different operative position.
Figure 4:
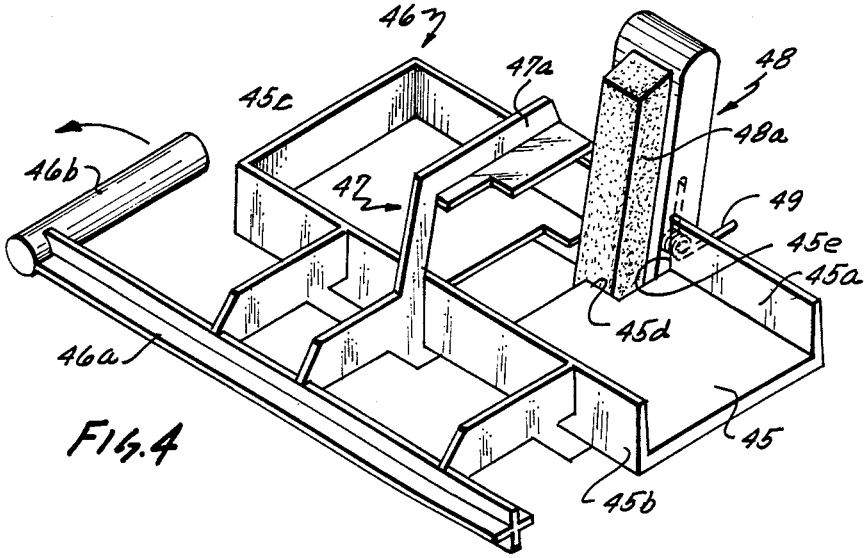
FIG. 4 is a perspective view of the mechanism shown in the structure of FIG. 2.

Referring now to FIGS. 2, 3 and 4, the action mechanism associated with the first bay 14 of the structure 12 will be described. A toy vehicle 40 is depicted therein, the vehicle 40 being of a die cast configuration with a spring-loaded body panel member 42 rotatable from a first to a second position, and having a first body panel surface thereof configured normally, and a second body panel surface configured with a damaged configuration to simulate damage occasioned by a collision. Such toy vehicles are more fully shown and described in the aforementioned related patent application, but briefly, the rotatable body component 42 may be in the rear of the vehicle 40, the front thereof, on a side thereof, or even on the roof thereof, and in any event such component 42 is rotatable from its normal position under force of a spring actuated by impact of the vehicle 40 with an object or another vehicle, the impact causing release of a catch mechanism on the vehicle 40. The component 42 may then be returned to its normal position by rotation thereof until latched upon engagement with the catch mechanism.

The play setting herein is provided with certain action mechanisms for simulating repair of side, front or rear damage; or alternatively, certain mechanisms are adapted for impact with the toy vehicle 40 which cause simulated damage to the vehicle 40, or to the structure 12. The mechanism depicted in FIGS. 2–4, is of the "repair" type, for coaction with the side of a vehicle 40 to rotate the component 42 to its original or normal position, to thus simulate the repair of the vehicle prior to exit from the bay 14.

The side repair mechanism, generally designated 44, includes a manually operated lift cage 46 and a spring biased friction arm 48. The lift cage 46 is an integrally formed structure for captively retaining the toy vehicle 40 therein by the top and bottom thereof while permitting forward and rearward movement of the vehicle 40 for ingress and egress relative to bay 14. For this purpose, the cage 46 includes a lower floor portion 45 which is positioned within a recess of the surface 10 for enabling movement of the vehicle 40 onto the floor 45. The floor 45 includes first and second sidewalls **45*a* and 45*b* and a rear wall 45*c*. A generally L-shaped arm 47 extends up from sidewall 45*b*, with a portion 47*a* thereof generally parallel to the floor 45, the arm 47 being configured and positioned for proximate relation to the top of the vehicle 40, with the vehicle 40 positioned on the floor 45**.

The cage 46 is pivotally coupled within the structure 12 by means of a pivot shaft **46*a* formed therewith, the shaft 46*a* being suitably pivotably coupled to the surface 10 within the structure 12. Pivoting about the shaft 46*a* is accomplished by manual rotation via operating lever 46*b* which is coupled at one end of shaft 46*a* in a direction generally perpendicular thereto. With pivoting of the operating lever 46*b*, the entire cage 46 and vehicle 40** thereon pivots.

On the side of the vehicle 40 including the pivotable component 42, the floor 45 of the cage 46 is cutaway at **45*d*, and the sidewall 45*a* is cutaway at 45*e* to provide access for operation of the friction arm 48. Friction arm 48 is formed of a generally rigid bar-shaped plastic material with a friction material pad 48*a* bonded to a surface thereof for coaction with the rotatable component 42 of the toy vehicle 40. As best shown in FIGS. 2 and 3, the arm 48 is pivotably coupled at its lower end to the surface 10 within the structure 12. A bias spring 49 urges the friction arm 48 counterclockwise, as viewed in the drawings, toward the vehicle 40**.

In the normal position shown in FIG. 2, the edge **45*d* of the floor 45 urges the arm 48 clockwise against the force of its bias, and out of engagement with the side of the vehicle 40. As the lever arm 46*b* of the cage 46 is operated, the cage 46 rises along with the vehicle 40. Then, as shown in FIG. 3, the operating lever 46*b* is pivoted in the opposite direction, and with friction pad 48*a* urged into contact with the rotatable component 42** of the vehicle 40, the component 42 rotates counterclockwise until engaged, at which point, the component 42 of the vehicle 40 has the non-damaged side thereof exposed, thus providing the illusion of repair work being performed within the bay 14 of the structure 12 as the vehicle 40 exits therefrom.

Figure 5:
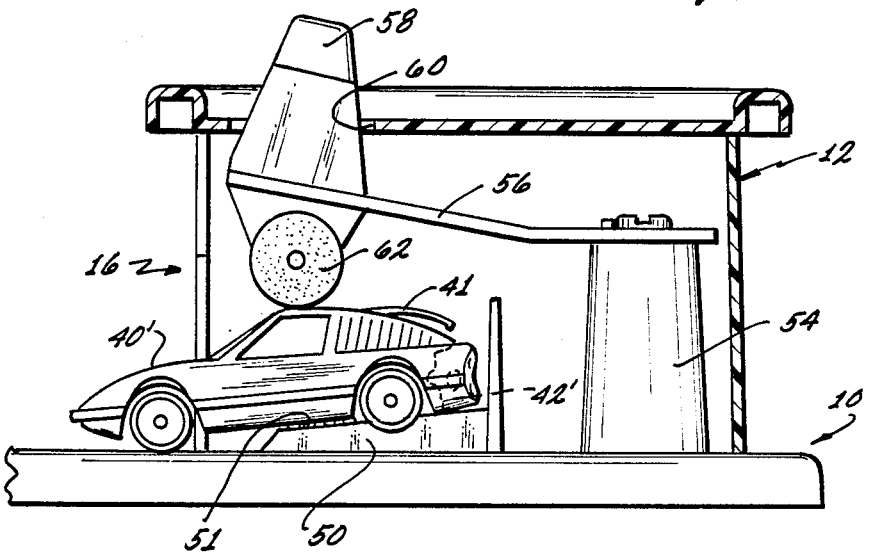
FIG. 5 is a side elevational view of a portion of the structure of FIG. 2, partially in cross-section, as viewed generally along line 5—5 thereof, with a toy vehicle therein to illustrate another form of repair mechanism for the toy vehicle.
Figure 6:
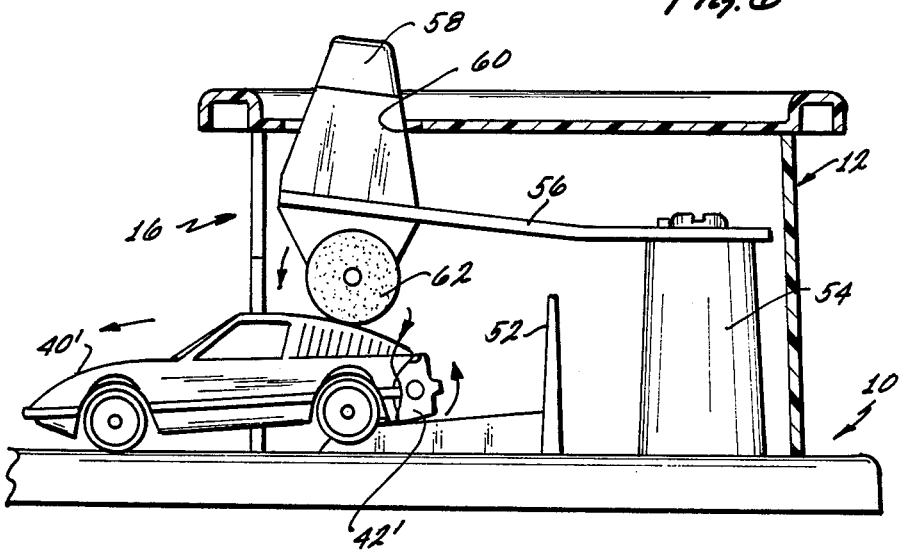
FIG. 6 is a side elevational view similar to FIG. 5, with the toy vehicle thereof in another position to illustrate the operation of the mechanism.

FIGS. 5 and 6 depict an alternate form of repair mechanism positioned within bay 16 of the structure 12, this mechanism being adapted for rotation of the component 42' of a second toy vehicle 40', which simulates damage to the rear of the vehicle 40'. In this type of vehicle 40', a lower surface of the rotatable component 42' at the rear of the vehicle 40' is engaged. This engagement is accomplished by providing a ramp member 50 which has a friction pad 51 formed therewith, the width of the ramp 50 being less than the width between the wheels of the vehicle 40', which is "backed-up" onto the ramp 50. A rear wall 52 is provided at the inside raised end of the ramp 50 to limit inward movement of the vehicle 40'.

With toy vehicles 40' of the type having a component 42' simulating rear (or front) damage, the rear hatch 41 (or the hood, in the case of simulated front damage) sets the catch mechanism for maintaining the rotatable body component 42' in its normal position with the undamaged panel visible. To accomplish this setting of the catch, rearwardly of the ramp 50, there is secured to the surface 10 a post member 54, supporting a resilient arm 56 which has a manually operable plunger portion 58 extending up through an opening 60 in the roof of the structure 12. In depending relation with the plunger portion 58 is a rotatably coupled wheel 62, which may be forced into engagement with the upper surface of the toy vehicle 40'. As the vehicle 40' is withdrawn from the bay 16 with the plunger 58 depressed, the wheel 62 comes into contact with the rear hatch 41 as the friction pad 51 rotates the component 42' counterclockwise, thus setting the catch mechanism as the vehicle 40' is withdrawn. Upon exit from the bay 16, the "undamaged" panel of the component 42' is in place, and latched, thus providing the illusion of repair of the rear of the toy vehicle 40'. It is to be understood that this mechanism may likewise be employed with such toy vehicles having the rotatable component 42' on the front thereof with the hood thereof acting to latch the component in position.

Figure 7:
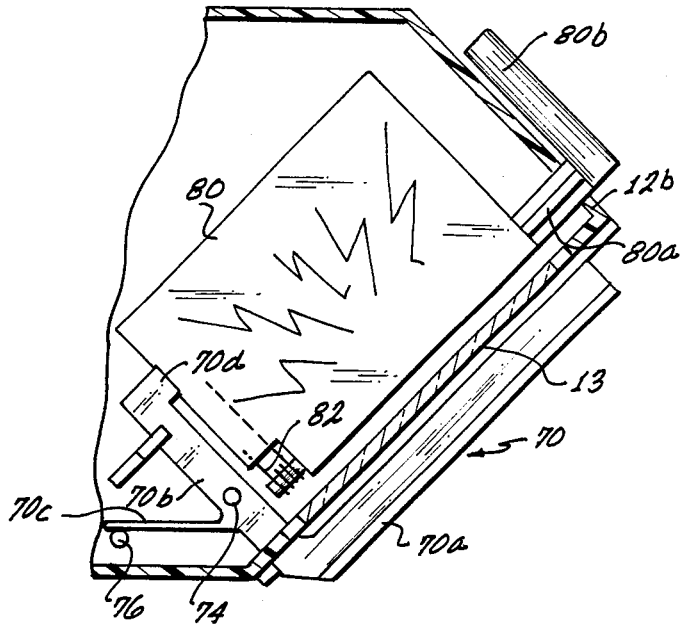
FIG. 7 is a partial cross-sectional view of the structure of FIG. 2 as viewed generally along line 7—7 thereof to illustrate a window damage simulation mechanism.
Figure 8:
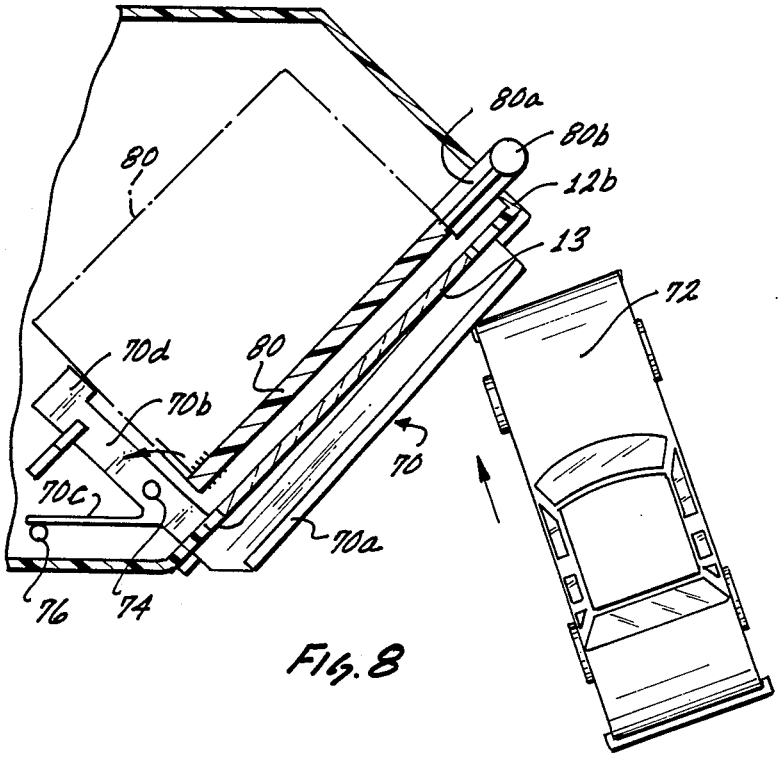
FIG. 8 is a partial cross-sectional view of the structure of FIG. 3, taken generally along line 8—8 thereof, the view being similar to FIG. 7 and depicting the window damage simulation mechanism in an operative position.

Referring now to FIGS. 7 and 8, another form of damage simulating mechanism is illustrated, this mechanism being housed within the structure 12. By referring to FIG. 1, the structure 12 has a generally transparent simulated window member 13 adjacent one end thereof. Below the window 13 is an impact actuating lever 70, which actuates the mechanism of FIGS. 7 and 8 upon impact of a vehicle 72 therewith. The impact lever 70 is generally L-shaped with the long leg **70*a* thereof having a broad front surface for engagement with the vehicle 72. The short leg 70*b* extends into the interior of the structure 12 and is pivotally coupled to the surface 10 by a pivot pin 74 with an integrally formed bias prong 70*c* being positioned against a projection 76 secured to the surface 10, thus urging the lever 70 clockwise as viewed in FIG. 7**.

Within the structure 12, a broken window simulating member 80 is pivotally coupled to the surface 10 by an integrally formed shaft member **80*a*, which has a bias spring 82 thereon urging between the surface 10 and the window member 80, thereby urging the member 80 into an upright, or vertical position. For retaining the window member 80 in a horizontal position, the other end of shaft 80*a* extends through an opening 12*b* in the structure 12 and has a reset lever 80*b* perpendicular thereto accessible from the exterior of the structure 12**.

With the reset lever **80*b* depressed, a catch portion 70*d* at the end of arm 70*b* overlies the window member 80 to retain the same against the force of spring 82. As shown in FIG. 8, upon impact of the vehicle 72 with the long arm 70*a* of the impact lever, the lever 70 is pivoted counterclockwise, thus releasing the window member 80 from catch 70*d* allowing member 80 to pivot into an erect position in proximate relation to the window member 30. With window 30 being formed of a generally transparent material, the simulated broken window member 80 will be viewable therethrough, thus providing the illusion of damage to the structure 12 on impact by the vehicle 72**.

Figure 9:
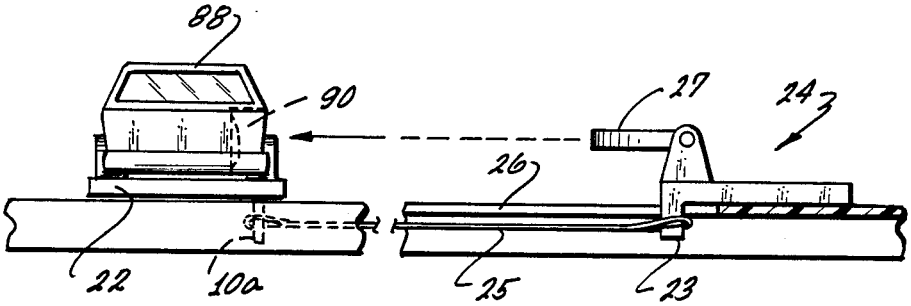
FIG. 9 is a side elevational view of a toy vehicle on another mechanism of the play setting of FIG. 1, partially in cross-section, as viewed generally along line 9—9 thereof.

Referring now to FIGS. 1 and 9, a collision test mechanism is depicted in which a vehicle 88 is depicted on the rack 22 in line with an impact sled 24. The toy vehicle 88 includes a rotatable side component 90, which in the normal position has the undamaged panel thereof in the outermost position. The sled 24 is operable within the slot 26 with the sled 24 having a depending portion 23 extending through the slot where the lowermost end thereof captively retains one end of an elastic band 25, the other end of which is connected to a projection **10*a* beneath the surface 10. The sled 14 is withdrawn manually against the force of the band 25, and then released, whereupon a ram 27 carried by the sled 24 impacts with the component 90 of the vehicle 88, thereby releasing the catch mechanism and pivoting component 90 so that the damaged panel thereof is in viewing position. Thereafter, the vehicle 88 may be positioned within bay 14 for "side repair" of the component 90. Vehicles having front or rear rotatable components may likewise be used with this mechanism, inasmuch as the rack 22, with a toy vehicle, such as vehicle 40' thereon, may be rotated to position the front or rear of a toy vehicle in the path of the ram 27**.

Although certain components have been identified as separate parts, it is to be understood that for manufacturing purposes, some components may be integrated with others. For example, the friction pad 51 may be integrally formed with the ramp 50. Similarly, the arm 56 may have the wheel 62 formed therewith, rather than as a separate component. The rotatable rack member 22 may be eliminated with wheel depressions molded into the base 10, and the ram 27 may be formed with the sled 24 as a unit. Such modifications would be readily obvious to one skilled in the art.

Other devices may be utilized with the setting hereinabove described, for example, loosely positioned pylons, barriers or the like. While there has been shown and described a preferred embodiment, it is to be understood that various other adaptations and modifications may be made within the spirit and scope of the invention.

We claim:

1. In a play setting for use with a toy vehicle having a component rotatable between a first position having a simulated damaged body panel surface and a second position having a normal body panel surface, the combination comprising:

a supporting surface;

means on said surface for retaining said toy vehicle in a predetermined position, said retaining means including cage means for holding said toy vehicle, said cage means being pivotable;

means adjacent said retaining means for engaging said rotatable component, said engaging means including a pivotable arm member having a friction pad for engaging said rotatable component upon pivoting of said cage means relative to said arm member for pivoting said component from said first position to said second position for simulating the repair of said vehicle; and means responsive to relative movement between one of said engaging means and said toy vehicle for enabling rotation of said component from one of said first and second positions to the other of said first and second positions.

2. The combination according to claim 1 wherein said retaining means and said engaging means are enclosed within a structure.

3. The combination according to claim 1 wherein said surface has means for connection to track members for carrying said toy vehicles to and from said surface.

4. In a play setting for use with a toy vehicle having a component rotatable between a first position having a simulated damaged body panel surface and a second position having a normal body panel surface, the combination comprising:

a supporting surface;

means on said surface for retaining said toy vehicle in a predetermined position;

means adjacent said retaining means for engaging said rotatable component; and means responsive to relative movement between one of said engaging means and said toy vehicle for enabling rotating of said component from one of said first and second positions to the other of said first and second positions, said engaging means including means for impacting said rotatable component for enabling rotation thereof from said second position to said first position for simulating a collision, said retaining means including means for positioning said vehicle in the path of said impact means with said rotatable component in the path of impact, said impact means including a movable sled member and said retaining means including a pivotable rack member for receiving a toy vehicle thereon.

5. The combination according to claim 4 wherein said sled member has a ram portion and is propelled by an elastic band.

6. In a play setting for use with a toy vehicle having a component rotatable between a first position having a simulated damaged body panel surface and a second position having a normal body panel surface, the combination comprising:

a supporting surface;

means on said surface for retaining said toy vehicle in a predetermined position;

means adjacent said retaining means for engaging said rotatable component, said engaging means including ramp means with friction means thereon for engaging said component, said retaining means including arm member means for urging said toy vehicle into contact with said friction means for enabling rotation of said component on moving said vehicle relative to said friction means for rotating said component from said first position to said second position for simulating repair of the vehicle, said arm member means including (a) a post member attached to said surface, (b) a resilient arm supported by said post member, (c) a plunger portion attached to said resilient arm, and (d) a rotatably coupled wheel mounted on said resilient arm capable of engaging said toy vheicle; and means responsive to relative movement between one of said engaging means and said toy vehicle for enabling rotation of said component from one of said first and second positions to the other of said first and second positions.

* * * * *